US009488927B2

(12) United States Patent
Chun et al.

(10) Patent No.: US 9,488,927 B2
(45) **Date of Patent: *Nov. 8, 2016**

(54) PRINTING SYSTEMS AND METHODS OF USING SUCH PRINTING SYSTEMS

(75) Inventors: Doris Pik-Yiu Chun, Palo Alto, CA (US); Henryk Birecki, Palo Alto, CA (US); Hou T. Ng, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 177 days.

This patent is subject to a terminal disclaimer.

(21) Appl. No.: 13/643,930

(22) PCT Filed: Apr. 30, 2010

(86) PCT No.: PCT/US2010/033269

§ 371 (c)(1),
(2), (4) Date: Oct. 26, 2012

(87) PCT Pub. No.: WO2011/136812

PCT Pub. Date: Nov. 3, 2011

(65) Prior Publication Data

US 2013/0038665 A1 Feb. 14, 2013

(51) Int. Cl.
*G03G 15/01* (2006.01)
*G03G 9/12* (2006.01)
(Continued)

(52) U.S. Cl.
CPC ..... *G03G 15/0157* (2013.01); *G03G 9/122* (2013.01); *G03G 9/125* (2013.01);
(Continued)

(58) Field of Classification Search
CPC ..... G03G 9/122; G03G 9/125; G03G 9/13; G03G 15/0157; G03G 15/0173; G03G 15/2092; G03G 15/169; G03G 2215/169; G03G 2215/1695
USPC ..... 347/103, 102, 101, 100, 51
See application file for complete search history.

(56) References Cited

U.S. PATENT DOCUMENTS 5,395,721 A 3/1995 Kato et al.
5,707,433 A 1/1998 Kuge et al.
(Continued)

FOREIGN PATENT DOCUMENTS

WO WO2008048983 4/2008
WO WO2009053311 4/2009

OTHER PUBLICATIONS

Groza et al. "Infrared Spectral Investigation of the Linseed Oil Polymerization in a Corona Discharge in Air at Atmospheric Pressure," (2004), Europhysics Letters, vol. 68, No. 5, pp. 652-657.
(Continued)

*Primary Examiner* — Henok Legesse
(74) *Attorney, Agent, or Firm* — Dierker & Kavanaugh, P.C.

(57) ABSTRACT

A printing system (30, 40, 40', 50, 50') includes at least one ejector coupled to a reservoir (38) that is configured to contain a printing composition including a hydrocarbon having at least one unsaturated bond. The hydrocarbon is configured to at least one of polymerize or crosslink in the presence of a reactive species. The at least one ejector is configured to eject the printing composition onto a surface (34, 36, 10). The system (30, 40, 40', 50, 50') further includes a corona generator (32, 32', 32'', 32''') configured to generate the reactive species in situ. The corona generator (32, 32', 32'', 32''') is positioned with respect to the reservoir (38) such that the reactive species is exposed to the printing composition after the printing composition has been ejected onto the surface (34, 36, 10). The polymerizing and/or the cross-linking of the hydrocarbon is configured to form a polymer matrix (12) from the ejected printing composition.

23 Claims, 6 Drawing Sheets

(51) Int. Cl.

| | |
|---|---|
| ***G03G 9/125*** | (2006.01) |
| ***G03G 9/13*** | (2006.01) |
| ***G03G 15/16*** | (2006.01) |
| ***G03G 15/20*** | (2006.01) |

(52) U.S. Cl.
CPC ..... *G03G 9/13* (2013.01); *G03G 15/0173* (2013.01); *G03G 15/169* (2013.01); *G03G 15/2092* (2013.01); *G03G 2215/169* (2013.01); *G03G 2215/1695* (2013.01)

(56) References Cited

U.S. PATENT DOCUMENTS

| | | | |
|---|---|---|---|
| 5,772,741 | A | 6/1998 | Spinelli |
| 5,821,019 | A | 10/1998 | Nguyen |
| 6,053,438 | A | 4/2000 | Romano, Jr. et al. |
| 6,166,105 | A | 12/2000 | Santilli et al. |
| 6,258,155 | B1 | 7/2001 | Guistina et al. |
| 6,281,268 | B1 | 8/2001 | Romano, Jr. et al. |
| 6,815,014 | B2 | 11/2004 | Gabelnick et al. |
| 7,387,352 | B2 | 6/2008 | Florence et al. |
| 2003/0055128 | A1 | 3/2003 | Jakubchak |
| 2003/0134940 | A1 | 7/2003 | Morrison et al. |
| 2005/0168558 | A1* | 8/2005 | Moore ..... G03G 15/108 347/112 |
| 2005/0223939 | A1 | 10/2005 | Uozumi et al. |
| 2007/0142493 | A1 | 6/2007 | Overend et al. |
| 2007/0219292 | A1 | 9/2007 | Ookubo et al. |
| 2009/0136696 | A1 | 5/2009 | Faltermeier et al. |
| 2009/0226839 | A1* | 9/2009 | Teishev ..... G03G 9/125 430/115 |
| 2009/0311540 | A1 | 12/2009 | Cohen et al. |
| 2010/0047454 | A1* | 2/2010 | De Voeght ..... B41J 2/211 427/256 |
| 2010/0086701 | A1 | 4/2010 | Iftime et al. |
| 2013/0041069 | A1* | 2/2013 | Chun ..... C09D 11/101 523/171 |

OTHER PUBLICATIONS

International Searching Authority, "Search Report," issued in connection with International Application No. PCT/US2010/003269, mailed on Dec. 15, 2010, 3 pages.

* cited by examiner

PRINTING SYSTEMS AND METHODS OF USING SUCH PRINTING SYSTEMS

BACKGROUND

The present disclosure relates generally to printing systems.

Digital printing is a process that generally involves reproducing a digital or computerized image onto a print medium. This process is typically accomplished using a digital printing system that utilizes electrical charges (electric field) to transfer a printing composition (such as an ink, a toner, or the like) onto the print medium during printing. In some instances, the composition is printed directly onto the print medium, and in other instances, the composition is printed onto an intermediate transfer medium and is then transferred to the print medium. The transferred printing composition forms an image on the medium, where such image substantially identically reflects the original digital or computerized image.

BRIEF DESCRIPTION OF THE DRAWINGS

Features and advantages of embodiments of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Embodiment(s) of the printing system as disclosed herein are digital printing systems that may be used to establish a polymer matrix on a substrate. The printing composition used to create the polymer matrix includes a carrier that is configured to be crosslinked and/or polymerized in the presence of a reactive (e.g., charged) species. Rather than using a chemical-based initiator (whose by-products may, in some cases, have deleterious side effects), the embodiment(s) of the system advantageously utilize the reactive species that is discharged from one or more corona generators operatively disposed in the digital printing system. The corona generators used to initiate crosslinking and/or polymerization are operatively positioned downstream of where the printing composition is printed.

The carrier is configured to be directly crosslinked and/or polymerized (which may be the result of extensive crosslinking) in the presence of a charged species, and then transferred onto the surface of the desirable print medium or substrate. The polymerizing and/or crosslinking of the carrier results in the formation of a polymer matrix, which may, in some instances, be a thin film or layer having a substantially continuous polymer network (i.e., film or layer in which the polymer coverage extends over a length or diameter of at least 100 μm). It is to be understood, however, that the resulting polymer matrix may be printed in any desirable pattern, including dot patterns (e.g., where each dot has a diameter of at least 5 μm), line patterns (e.g., where each line has a width of at least 5 μm), or any other desirable geometric pattern. In embodiment(s) where the printing composition includes a colorant, the initial polymerizable and/or crosslinkable carrier serves as a medium that suspends the colorant therein. As polymerization and/or crosslinking occurs, the colorant becomes embedded in the resulting solid polymerized and/or crosslinked matrix of the carrier. More specifically, the solid polymer/crosslinked matrix provides a network to suspend and retain the colorant, which protects the colorant from physical damage, such as, e.g., rubbing and scratching, and enhances the water and solvent fastness of the prints. As such, this embedded colorant configuration advantageously protects the printed image (i.e., the polymer matrix transferred to the substrate surface) at least against chemical and/or physical deterioration caused, for example, from oxidation, exposure to moisture, and rub or highlighter smearing.

Figure 1:
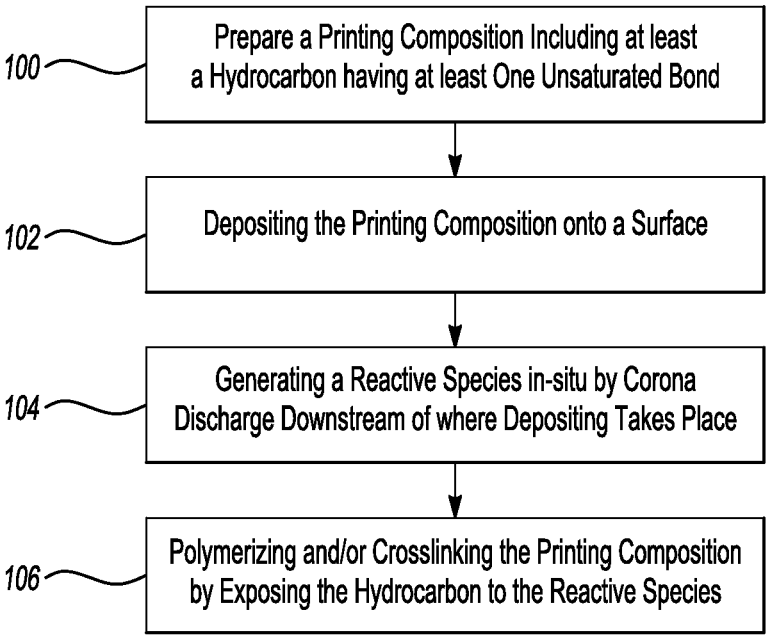
FIG. 1 is a flow diagram depicting an embodiment of the printing method disclosed herein.

An example of the printing method is generally depicted in FIG. 1. The method begins by preparing the printing composition (as shown by reference numeral 100).

The printing composition prepared herein is configured to be printable by a digital printing system or printer. Non-limiting examples of digital printing systems or printers are shown in FIGS. 2, 3A, 3B, 4 and 5, and include digital inkjet printers, digital laser printers, electrophotographic printers, or combinations thereof. As such, the printing composition disclosed herein may also be referred to as a digital printing composition.

The printing composition is a liquid composition, a solid composition, or a composition having a phase that is between a liquid and a solid (such as, e.g., a paste) depending, at least in part, upon the digital printing system to be used. As will be described in further detail below, the printing composition may be a fixer or gloss enhancer, an ink, or a toner. As such, some embodiments of the printing composition prepared herein include, in its simplest form, a carrier. In other embodiments, the printing composition includes the carrier and a colorant. In yet further embodiments, it may be desirable to also add solvents, such as long chain alcohols (i.e., number of carbon is greater than 6) and alkane diols and polymeric additives (e.g., oil-soluble polymers). Still further, it may be desirable that some of the embodiments of the printing composition disclosed herein may or may not include other additives, such as, e.g., binder, solvents, surfactants, etc. The addition or elimination of additives from the compositions disclosed herein will depend, at least in part, upon the jetting technique used. For example, when jetting the oil-based inks thermally, nucleation agents, such as the previously mentioned alcohols may be desirable; and when jetting the oil-based inks with a piezoelectric printhead, polymers may be used to increase the viscosity. Generally, the total solvent, when used, will be present in an amount less than 10 wt. % of the composition; and/or the total binder, when used, will be present in an amount less than 5 wt. % of the total wt. % of the composition.

The carrier present in the embodiments of the composition disclosed herein may be a liquid, a solid, or a phase between a liquid and a solid (such as, e.g., a paste) depending, at least in part, upon the digital printing system to be used. When a solid carrier is utilized, it is to be understood that the heat generated during printing melts the solid carrier to enable printing. Solid carriers may begin to re-solidify on their own due to the decrease in temperature after melting and printing. However, it is believed that exposing the melted and printed previously-solid carrier to a charged species may decrease the time for the re-solidification process by initiating or enhancing (i.e., speeding up) polymerization and/or crosslinking.

In embodiments of the composition in which the carrier alone is utilized (i.e., no colorant, dispersant, or other additive is present), the printing composition is a fixer fluid or a gloss enhancer that includes a substantially optically transparent liquid or solid that melts during printing. In such embodiments, the "substantially optically transparent carrier" is a hydrocarbon (initially in liquid or solid form) that, when printed, does not exhibit or exhibits minimal color, and/or transmits more than 90% of light (in the visible spectrum range) incident thereon. The substantially optically transparent carrier may therefore be completely transparent, or may be a slight variation thereof. When colorants are added to the substantially optically transparent carrier, the composition exhibits the shade or hue of the colorant used.

For liquid-based, solid-based, and paste-based carriers, the carrier is oil-based and generally includes a hydrocarbon polymer precursor (also referred to herein as a "hydrocarbon") that is configured to, from its liquid form, polymerize and/or crosslink in the presence of a reactive species. More specifically, the embodiments of the carrier disclosed herein each include a hydrocarbon having at least one degree of unsaturation. In an example, the hydrocarbon includes a single unsaturated bond (i.e., a C=C bond). In other embodiments, the hydrocarbon includes two, three, or more unsaturated bonds. It is to be understood that, for these other embodiments, the hydrocarbon may have as many unsaturated bonds as desirable. It is to be understood that any hydrocarbon having one or more unsaturated bonds may be used as the carrier so long as the hydrocarbon will polymerize and/or crosslink in the presence of the reactive species. It is to be further understood that the hydrocarbon is also printable via a digital printer or printing system (i.e., where the hydrocarbon, when incorporated into the printing composition, can be printed without clogging the nozzles of the printhead or other fluid flow components of the system, etc.). Printable hydrocarbons may be selected from those having a viscosity ranging from about 5 cP to about 100 cP. For printing systems utilizing printheads (e.g., thermal or piezoelectric printheads), the hydrocarbons may be selected from those having a viscosity ranging from about 10 cP to about 35 cP. Furthermore, the surface tension of the hydrocarbon desirably ranges from about 24 dynes/cm to about 30 dynes/cm. In some cases, the elasticity is also a factor in selecting the hydrocarbon for the carrier.

Some specific examples of hydrocarbons that may be used in embodiments of the printing composition disclosed herein are now provided. In one example, the hydrocarbon may be an oil. In an example, the oil is selected from a dielectric material having a conductivity up to 200 pS/cm. In another example, the oil has a conductivity of equal to or less than 1 pS/cm. Examples of suitable oils include, but are not limited to unsaturated fatty acids, glycerides, or combinations thereof, some non-limiting examples of which include: 1-palmitoyl-2-oleoyl-glycerol; capric glycerides (such as those of the MIGLYOL® series manufactured by Sasol, Johannesburg, South Africa); glycerol stearates (such as those of the IMWITOR® series also manufactured by Sasol); Linseed oil; and combinations thereof.

In another example, the hydrocarbon is selected from those where one or more of the unsaturated bond(s) is/are conjugated. Some non-limiting examples of these hydrocarbons include: dienes (i.e., polyunsaturated fatty acids containing conjugated double bonds, such as Omega 3, Omega 6, and Omega 9 acids); enones (such as methyl vinyl ketone and chalcone); or terminal olefins. Non-limiting examples of such terminal olefins include styrenes (e.g., styrene, methylstyrene, vinylstyrene, dimethylstyrene, chlorostryene, dichlorostyrene, tert-butylstyrene, bromostyrene, and p-chloromethylstyrene), monofunctional acrylic esters (e.g., methyl acrylate, ethyl acrylate, isopropyl acrylate, n-butyl acrylate, butoxyethyl acrylate, isobutyl acrylate, n-amyl acrylate, isoamyl acrylate, n-hexyl acrylate, octyl acrylate, decyl acrylate, dodecyl acrylate, octadecyl acrylate, benzyl acrylate, phenyl acrylate, phenoxyethyl acrylate, cyclohexyl acrylate, dicyclopentanyl acrylate, dicyclopentenyl acrylate, dicyclopentenyloxyethyl acrylate, tetrahydrofurfuryl acrylate, isobornyl acrylate, isoamyl acrylate, lauryl acrylate, stearyl acrylate, benhenyl acrylate, ethoxydiethylene glycol acrylate, methoxytriethylene glycol acrylate, methoxydipropylene glycol acrylate, phenoxypolyethylene glycol acrylate, nonylphenol EO adduct acrylate, isooctyl acrylate, isomyristyl acrylate, isostearyl acrylate, 2-ethylhexyl diglycol acrylate, and oxtoxypolyethylene glycol polypropylene glycol monoacrylate), monofunctional methacrylic esters (e.g., methyl methacrylate, ethyl methacrylate, isopropyl methacrylate, n-butyl methacrylate, i-butyl methacrylate, tert-butyl methacrylate, n-amyl methacrylate, isoamyl methacrylate, n-hexyl methacrylate, 2-ethylhexyl methacrylate, lauryl methacrylate, tridecyl methacrylate, stearyl methacrylate, isodecyl methacrylate, octyl methacrylate, decyl methacrylate, dodecyl methacrylate, octadecyl methacrylate, methoxydiethylene glycol methacrylate, polypropylene glycol monomethacrylate, benzyl methacrylate, phenyl methacrylate, phenoxyethyl methacrylate, cyclohexyl methacrylate, tetrahydrofurfuryl methacrylate, tert-butylcyclohexyl methacrylate, behenyl methacrylate, dicyclopentanyl methacrylate, dicyclopentenyloxyethyl methacrylate, and polypropylene glycol monomethacrylate), allyl compounds (e.g., allylbenzene, allyl-3-cyclohexane propionate, 1-allyl-3,4-dimethoxybenzene, allyl phenoxyacetate, allyl phenylacetate, allylcyclohexane, and allyl polyvalent carboxylate), unsaturated esters of fumaric acid, maleic acid, itaconic acid, etc., and radical polymerizable group-containing monomers (e.g., N-substituted maleimide and cyclic olefins). Non-limiting examples of suitable hydrophobic prepolymers include low molecular weight (e.g., where the molecular weight is less than 1000 and the viscosity is less than 300 cP)

acrylic oligomers, such as, e.g., polyethylene-co-acrylic acid, polystyrene-co-polyhexylacrylate, and polyethylene-co-methacrylic acid.

In still another example, the hydrocarbon may be selected from those that are halogenated, or include a ketone, or combinations thereof. Some non-limiting examples of hydrocarbons that are halogenated include fluorocarbons, such as TEFLON® (Dupont, Midland Mich.) and chlorinated polymers, such as polyvinyl chloride (PVC). A non-limiting example of a hydrocarbon including a ketone includes a polyacrylate. Some non-limiting examples of hydrocarbons that are both halogenated and include ketone(s) include alkyl chloroacrylates (e.g., methyl-2-chloroacrylate and ethyl-2-chloroacrylate) and ethyl-chloroacetate.

The carrier may, in some embodiments, include a single hydrocarbon selected from any of the hydrocarbons identified above. In other embodiments, the carrier may include combinations of two or more of the above-identified hydrocarbons. In an embodiment, the carrier may include a combination of a halogenated hydrocarbon and an oil, a mixture of various linseed oils, or a mixture of linseed oil and any other hydrocarbon(s) listed herein.

Additionally, the hydrocarbon alone typically constitutes the medium of the carrier. In some cases, it may be desirable to add other non-reacting oil-based components to the carrier. Non-limiting examples of the non-reacting oil-based components include aliphatic hydrocarbons, such as hexanes, heptanes, hexadodecane, and ISOPAR™ isoparaffinic fluids (Exxon Mobile, Houston, Tex.). When these non-reacting oil-based components are added, they may be present in an amount ranging from 0.5 wt. % to 5.0 wt. % of the total weight of the composition.

In instances where the printing composition is an ink or a toner, the printing composition further includes the colorant. As used herein, the term "colorant" refers to i) one or more pigments, ii) one or more dyes, or iii) combinations of pigment(s) and dye(s). In two non-limiting examples, the colorant may be selected from pigment particles that are self-dispersible in the carrier, or a combination of the self-dispersing pigment and a dye. In these examples, the printing composition includes the carrier and the pigment, or the carrier and the pigment and the dye alone (i.e., without additional components). In two other non-limiting examples, the colorant may be selected from pigment particles that are non-self-dispersible in the carrier, or a combination of the non-self-dispersing pigment and a dye. In the latter examples, the printing composition includes one or more dispersants in addition to the carrier and the pigment, or the carrier and the pigment and the dye. In yet another non-limiting example, the colorant is selected from a dye alone. In this example, the printing composition includes the carrier and the dye, without pigments and without dispersants. As previously mentioned however, solvents and/or binders may also be added.

The compositions disclosed herein may include 1 wt. % to 100 wt. % non-volatile solids (e.g., 100 wt. % includes when the carrier is a solid). When the colorant is included, the colorant can make up from about 1.5 wt. % to about 50 wt. % of the total non-volatile solids.

When utilized, the dispersant is selected so that it is at least partially soluble in the selected carrier. For example, in instances where the carrier is an oil-based hydrocarbon (e.g., unsaturated fatty acids, glycerides, etc.), the dispersant may be selected from dispersants that are at least partially soluble in the oil-based hydrocarbon. The dispersants may be selected from anionic dispersants, cationic dispersants, amphoteric dispersants, non-ionic dispersants, polymeric dispersants, oligomeric dispersants, crosslinking dispersants, or combinations thereof. Examples of anionic dispersants include sulfosuccinic acid and derivatives thereof such as, for instance, alkyl sulfosuccinates (such as GEROPON® SBFA-30 and GEROPON® SSO-75, both of which are manufactured by Rhodia, Boulogne-Billancourt, France) and docusate sodium. Examples of cationic dispersants include quaternary amine polymers, protonated amine polymers, or polymers containing aluminum (such as those that are available from Lubrizol Corp., Wickliffe, Ohio). Further examples of cationic dispersants include SOLSPERSE® 19000 (Lubrizol Corp.) and other like cationic dispersants. Amphoteric dispersants include those that contain compounds having protonizable groups and/or ionizable acid groups. A non-limiting example of a suitable amphoteric dispersant includes lecithin. Examples of non-ionic dispersants include, but are not limited to oil-soluble polyesters, polyamines, polyacrylates, polymethacrylates (such as, e.g., SOLSPERSE® 3000 (Lubrizol Corp.), SOLSPERSE® 21000 (Lubrizol Corp.), or the like). Non-limiting examples of oligomeric dispersants include low average molecular weight (i.e., less than 1000) non-ionic dispersants. Examples of cross-linking dispersants include, but are not limited to, polymers or oligomers containing two or more carbon double bonds (C═C) and free amine groups, such as, e.g., polyamines, crosslinkable polyurethanes, and divinyl benzene.

When a dispersant is used, the dispersant may be included in an amount ranging from about 2 wt. % to about 100 wt. % of the total non-volatile solids present. In one non-limiting example, the dispersant is present in an amount of about 10 wt. %.

In the embodiments where the colorant is or includes a pigment, the pigment may be selected from organic pigments or inorganic pigments particles, and such particles may have any particle size that allows the composition including the pigment to be printed from the digital printer. In an example, the particle size of the pigments range from about 1 nm to about 10 μm. In another example, the particle size of the pigments range from about 100 nm to about 300 nm. In still another example, particle size ranges from about 1 μm to about 20 μm. Organic or inorganic pigment particles may be selected from, but are not limited to, black pigment particles, yellow pigment particles, magenta pigment particles, red pigment particles, cyan pigment particles, blue pigment particles, green pigment particles, orange pigment particles, brown pigment particles, and white pigment particles. In some instances, the organic or inorganic pigment particles may include spot-color or specialty pigment particles. Spot-color pigments are formed from a combination of a predefined ratio of two or more primary color pigment particles. Specialty pigments may, e.g., be metallic, fluorescent and/or opalescent pigments.

A non-limiting example of a suitable inorganic black pigment includes carbon black. Examples of carbon black pigments include those manufactured by Mitsubishi Chemical Corporation, Japan (such as, e.g., carbon black No. 2300, No. 900, MCF88, No. 33, No. 40, No. 45, No. 52, MA7, MA8, MA100, and No. 2200B); various carbon black pigments of the RAVEN® series manufactured by Columbian Chemicals Company, Marietta, Ga., (such as, e.g., RAVEN® 5750, RAVEN® 5250, RAVEN® 5000, RAVEN® 3500, RAVEN® 1255, and RAVEN® 700); various carbon black pigments of the REGAL® series, the MOGUL® series, or the MONARCH® series manufactured by Cabot Corporation, Boston, Mass., (such as, e.g., REGAL® 400R, REGAL® 330R, and REGAL® 660R); and various black pigments manufactured by Evonik Degussa Corporation, Parsippany, N.J., (such as, e.g., Color Black FW1, Color Black FW2, Color Black FW2V, Color Black FW18, Color Black FW200, Color Black S150, Color Black S160, Color Black S170, PRINTEX® 35, PRINTEX® U, PRINTEX® V, PRINTEX® 140U, Special Black 5, Special Black 4A, and Special Black 4). A non-limiting example of an organic black pigment includes aniline black, such as C.I. Pigment Black 1.

Some non-limiting examples of suitable yellow pigments include C.I. Pigment Yellow 1, C.I. Pigment Yellow 2, C.I. Pigment Yellow 3, C.I. Pigment Yellow 4, C.I. Pigment Yellow 5, C.I. Pigment Yellow 6, C.I. Pigment Yellow 7, C.I. Pigment Yellow 10, C.I. Pigment Yellow 11, C.I. Pigment Yellow 12, C.I. Pigment Yellow 13, C.I. Pigment Yellow 14, C.I. Pigment Yellow 16, C.I. Pigment Yellow 17, C.I. Pigment Yellow 24, C.I. Pigment Yellow 34, C.I. Pigment Yellow 35, C.I. Pigment Yellow 37, C.I. Pigment Yellow 53, C.I. Pigment Yellow 55, C.I. Pigment Yellow 65, C.I. Pigment Yellow 73, C.I. Pigment Yellow 74, C.I. Pigment Yellow 75, C.I. Pigment Yellow 81, C.I. Pigment Yellow 83, C.I. Pigment Yellow 93, C.I. Pigment Yellow 94, C.I. Pigment Yellow 95, C.I. Pigment Yellow 97, C.I. Pigment Yellow 98, C.I. Pigment Yellow 99, C.I. Pigment Yellow 108, C.I. Pigment Yellow 109, C.I. Pigment Yellow 110, C.I. Pigment Yellow 113, C.I. Pigment Yellow 114, C.I. Pigment Yellow 117, C.I. Pigment Yellow 120, C.I. Pigment Yellow 124, C.I. Pigment Yellow 128, C.I. Pigment Yellow 129, C.I. Pigment Yellow 133, C.I. Pigment Yellow 138, C.I. Pigment Yellow 139, C.I. Pigment Yellow 147, C.I. Pigment Yellow 151, C.I. Pigment Yellow 153, C.I. Pigment Yellow 154, C.I. Pigment Yellow 167, C.I. Pigment Yellow 172, C.I. Pigment Yellow 180, and C.I. Pigment Yellow 185.

Non-limiting examples of suitable magenta or red organic pigments include C.I. Pigment Red 1, C.I. Pigment Red 2, C.I. Pigment Red 3, C.I. Pigment Red 4, C.I. Pigment Red 5, C.I. Pigment Red 6, C.I. Pigment Red 7, C.I. Pigment Red 8, C.I. Pigment Red 9, C.I. Pigment Red 10, C.I. Pigment Red 11, C.I. Pigment Red 12, C.I. Pigment Red 14, C.I. Pigment Red 15, C.I. Pigment Red 16, C.I. Pigment Red 17, C.I. Pigment Red 18, C.I. Pigment Red 19, C.I. Pigment Red 21, C.I. Pigment Red 22, C.I. Pigment Red 23, C.I. Pigment Red 30, C.I. Pigment Red 31, C.I. Pigment Red 32, C.I. Pigment Red 37, C.I. Pigment Red 38, C.I. Pigment Red 40, C.I. Pigment Red 41, C.I. Pigment Red 42, C.I. Pigment Red 48(Ca), C.I. Pigment Red 48(Mn), C.I. Pigment Red 57(Ca), C.I. Pigment Red 57:1, C.I. Pigment Red 88, C.I. Pigment Red 112, C.I. Pigment Red 114, C.I. Pigment Red 122, C.I. Pigment Red 123, C.I. Pigment Red 144, C.I. Pigment Red 146, C.I. Pigment Red 149, C.I. Pigment Red 150, C.I. Pigment Red 166, C.I. Pigment Red 168, C.I. Pigment Red 170, C.I. Pigment Red 171, C.I. Pigment Red 175, C.I. Pigment Red 176, C.I. Pigment Red 177, C.I. Pigment Red 178, C.I. Pigment Red 179, C.I. Pigment Red 184, C.I. Pigment Red 185, C.I. Pigment Red 187, C.I. Pigment Red 202, C.I. Pigment Red 209, C.I. Pigment Red 219, C.I. Pigment Red 224, C.I. Pigment Red 245, C.I. Pigment Violet 19, C.I. Pigment Violet 23, C.I. Pigment Violet 32, C.I. Pigment Violet 33, C.I. Pigment Violet 36, C.I. Pigment Violet 38, C.I. Pigment Violet 43, and C.I. Pigment Violet 50.

Non-limiting examples of blue or cyan organic pigments include C.I. Pigment Blue 1, C.I. Pigment Blue 2, C.I. Pigment Blue 3, C.I. Pigment Blue 15, C.I. Pigment Blue 15:3, C.I. Pigment Blue 15:34, C.I. Pigment Blue 15:4, C.I. Pigment Blue 16, C.I. Pigment Blue 18, C.I. Pigment Blue 22, C.I. Pigment Blue 25, C.I. Pigment Blue 60, C.I. Pigment Blue 65, C.I. Pigment Blue 66, C.I. Vat Blue 4, and C.I. Vat Blue 60.

Non-limiting examples of green organic pigments include C.I. Pigment Green 1, C.I. Pigment Green 2, C.I. Pigment Green, 4, C.I. Pigment Green 7, C.I. Pigment Green 8, C.I. Pigment Green 10, C.I. Pigment Green 36, and C.I. Pigment Green 45.

Non-limiting examples of brown organic pigments include C.I. Pigment Brown 1, C.I. Pigment Brown 5, C.I. Pigment Brown 22, C.I. Pigment Brown 23, C.I. Pigment Brown 25, and C.I. Pigment Brown, C.I. Pigment Brown 41, and C.I. Pigment Brown 42.

Non-limiting examples of orange organic pigments include C.I. Pigment Orange 1, C.I. Pigment Orange 2, C.I. Pigment Orange 5, C.I. Pigment Orange 7, C.I. Pigment Orange 13, C.I. Pigment Orange 15, C.I. Pigment Orange 16, C.I. Pigment Orange 17, C.I. Pigment Orange 19, C.I. Pigment Orange 24, C.I. Pigment Orange 34, C.I. Pigment Orange 36, C.I. Pigment Orange 38, C.I. Pigment Orange 40, C.I. Pigment Orange 43, and C.I. Pigment Orange 66.

In another embodiment, the pigment may be selected from metallic pigments, where the metallic pigments also have a particle size enabling the composition to be printed from the digital printer. In an example, the particle size of the metallic pigment ranges from about 0.1 μm to about 20 μm. Suitable metallic pigments include, but are not limited to, a metal selected from gold, silver, platinum, nickel, chromium, tin, zinc, indium, titanium, copper, aluminum, and alloys of any of these metals. These metals may be used alone or in combinations with two or more metals or metal alloys. Non-limiting examples of metallic pigments include Standard RO100, Standard RO200, and DORADO PX™ 4001 (available from Eckart Effect Pigments, Wesel, Germany).

In yet another embodiment, the pigment may be selected from a pearlescent pigment (also known as an opalescent pigment), where the pearlescent pigments have a particle size that enable the composition to be printed from the digital printer. In an example, the pearlescent particle size ranges from about 0.1 μm to about 20 μm. It is to be understood that suitable pearlescent pigments are those that tend to exhibit various colors depending on the angle of illumination and/or of viewing. Non-limiting examples of pearlescent pigments include those of the PRESTIGE® series and of the DORADO PX™ series, both of which are available from Eckart Effect Pigments.

Some non-limiting examples of dyes that may be used as the colorant or one of many colorants include fluorescein, rhodamine, nigrosine, and napthol green.

For liquid inks and toners, the printing composition may be prepared by dispersing the colorant (and, in some instances, the dispersant alone or in combination with binder(s) and/or solvent(s)) in the liquid carrier. Dispersing the colorant (and any other suitable components) may be accomplished using any suitable apparatus, non-limiting examples of which include a microfluidizer, mills, and ultrasonicators. In instances where a solid carrier is used, such carrier is heated to the melting point of the solid, and then the colorants (and other additives) are incorporated into the melt. Incorporation of the colorants into the melt may be accomplished, for example, by stirring and/or mixing, and then allowing the melt to cool and re-solidify.

In instances where the printing composition is a fixer, the composition is prepared by selecting the hydrocarbon for the carrier. If more than one hydrocarbon is selected for the carrier, the hydrocarbons are mixed together in a desirable ratio. As non-limiting examples, ISOPAR™ L is mixed with ISOPAR™ V in a ratio of 80:20, or linseed oil is mixed with ISOPAR™ L in a ratio of 90:10.

The compositions disclosed herein undergo crosslinking and/or polymerization when exposed to corona discharge for a brief time period (e.g., 1 minute or less). In order to decrease the corona discharge exposure time needed to initiate crosslinking and/or polymerization, the compositions disclosed herein may also include drying agents (i.e., dryers). Non-limiting examples of the dryers are fatty acid salt complexes derived from cobalt, manganese, or iron, with zirconium, lead, or calcium salts of fatty acids; such as, for example, 2-ethylhexanoic acid (e.g., cobalt (II) 2-ethylhexanoate and manganese bis-2-ethylhexanoate) and naphthenic acid (e.g., cobalt (II) naphthenate and ferric naphthenate). These drying agent(s) may be present in an amount ranging from about 0.1 wt. % to about 5 wt. %. In one non-limiting example, the drying agent is included in an amount ranging from about 0.5 wt. % to about 1 wt. %.

Once the printing composition is generated, the method continues with depositing the printing composition onto a surface (see reference numeral 102 in FIG. 1), generating a reactive species in-situ by corona discharge downstream of where the depositing takes place (see reference numeral 104 in FIG. 1), and initiating crosslinking and/or polymerization of the printing composition by exposing the hydrocarbon to the reactive species (see reference numeral 106 in FIG. 1).

The reactive species used to initiate crosslinking and/or polymerization is generated by a corona generator. It is to be understood that one or more additional corona generators may be included in the various embodiments of the system in order to i) create a uniform charge layer on the surface of a photoconductor, ii) further enhance crosslinking and/or polymerization of the formed polymer matrix, and/or iii) assist in transfer of the resulting polymer matrix to a desirable substrate. Each of these embodiments will be discussed further in reference to one of FIGS. 2 through 5.

Each of the corona generators described herein includes a power supply that is capable of supplying high voltage power to a conductor, such as a discharge electrode. The discharge electrode ionizes the atmosphere or gases surrounding the discharge electrode, thereby forming a reactive species that reacts with the printing composition. As such, the term "corona discharge" refers to an electrical discharge brought on by the ionization of the atmosphere or gases surrounding a conductor, which occurs when the potential gradient (the strength of the electric field) exceeds a certain value, but conditions are insufficient to cause complete electrical breakdown or arcing. The corona generator(s) may include insulation to prevent against electrical shocks, and a ground plate to ground the generator(s).

The conductor or discharge electrode may be a single wire or an array of wires (i.e., two or more) that are spaced apart by a distance ranging from about 500 μm to about 2 mm. Examples of suitable wire materials include metals, such as platinum, gold, palladium, titanium, alloys, etc. In the embodiments disclosed herein, the wires of the generator(s) are positioned parallel to the plane of the surface to be exposed to the corona discharge. This is believed to create a relatively uniform discharge field. The wire(s) of the generator(s) are also positioned 10 mm or less from the surface to be exposed to the corona discharge.

It is to be generally understood that each of the corona generators are capable of generating a relatively high electric field, where such electric fields are used by the digital printing system for image development and formation of the polymer matrix. In a non-limiting example, the electric charge or field of the corona discharge ranges from about 1 kV to about 5 kV when the current applied to the generator ranges from about 1 μA to about 1000 μA. The current may be convective current, which facilitates improved mixing in the final polymer matrix 12. Improved mixing is particularly desirable when colorants are included in the composition, at least in part because the print quality and durability of the resulting print 20 is enhanced.

Without being bound to any theory, it is believed that when each corona generator discharges, it forms a high energy species (such as, e.g., radicals, ions, etc.). At least one of the generators is positioned in the system such that the high energy species reacts with the unsaturated species (e.g., the hydrocarbons) in the deposited printing composition to cause crosslinking of the unsaturated species. If the high energy species can propagate through the deposited composition, polymerization takes place in addition to crosslinking. As such, instead of adding a radical initiator (such as AIBN) into the composition, a corona generator is included in the system to generate the high energy species in an area where the species can initiate crosslinking, and possibly polymerization, of the hydrocarbon present in the composition. The high energy species react with the surface of the deposited composition and crosslink from the top down, and/or propagate through the deposited composition causing polymerization.

In an example, the charged species used to polymerize and/or crosslink the hydrocarbon includes any molecular species having an electrical charge, such as, e.g., radicals, radical ions, carbenes, cations, anions, peroxides, acids, and bases. Some non-limiting examples of radicals and radical ions include oxy-radicals, hydroxyl radicals, nitroxide radicals, polycyclic aromatic hydrocarbon radicals, and respective ions of the previously listed radicals. Non-limiting examples of carbenes include those that may be generated photolytically from diazirines, epoxides, and halogenated hydrocarbons, such as chloroform. Examples of cations include, but are not limited to, any compound having a net positive charge, such as ammonium, carbonium, phosphonium, and hydronium. Examples of anions include, but are not limited to, any compound having a net negative charge, such as hydroxides, sulfides, hydrides, and deprotonated amines. Non-limiting examples of acids and bases include any compound having hydrogen bound to non-carbon atoms, or Lewis acids and bases. Examples of acids having hydrogen bound to non-carbon atoms include organic and inorganic acids, such as sulfuric acid, phosphoric acid, hydrochloric acid, nitric acid, phenol, fatty acids, benzolic acid, and acetic acid. Examples of bases having hydrogen bound to non-carbon atoms include amines, sulfides, and hydroxyls. Examples of Lewis acids include molecules capable of accepting electrons, such as those that include metal halides (e.g., aluminum chloride, boron trifluoride, phosphorus pentachloride, and boron trifluoride). Examples of Lewis bases includes molecules that can donate electrons to Lewis acids, such as compounds containing nitrogen, phosphorus, arsenic, antimony, and/or bismuth in oxidation state 3 or compounds containing oxygen, sulfur, selenium, and/or tellurium in oxidation state 2. Specific examples of Lewis bases include water, ethers, ketones, sulfoxides, and carbon monoxide. Non-limiting examples of peroxides include benzoyl peroxide and hydroperoxide.

It is to be understood that the steps shown in FIG. 1 may be accomplished differently depending upon the system used. As such, the embodiments of the method will now be further described in conjunction with the various systems shown in FIGS. 2 through 5.

Figure 2:
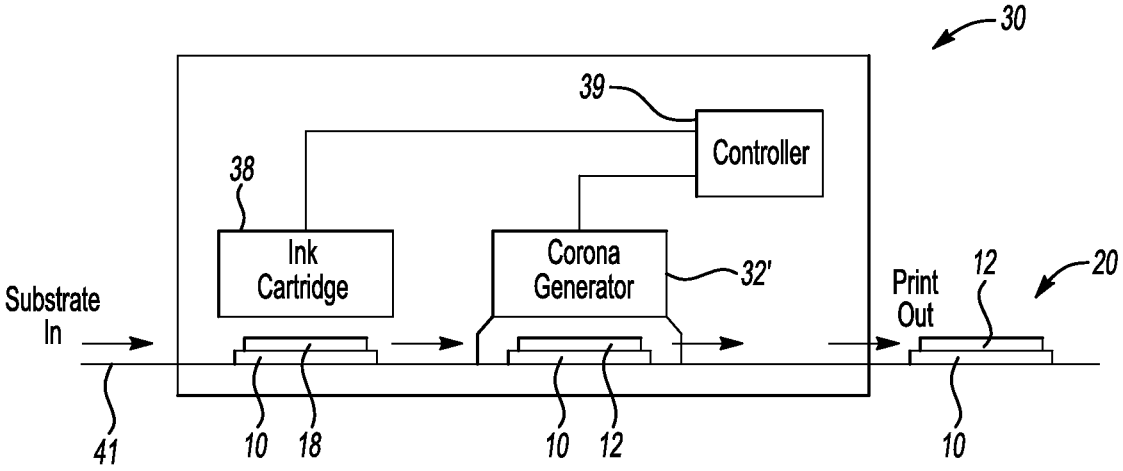
FIG. 2 is a schematic illustration of an embodiment of a digital printing system for performing the method depicted in FIG. 1 where the printing composition is printed directly onto a substrate.

Referring now to FIG. 2, an embodiment of the printing system 40 is depicted. This system 30 is one example of a digital inkjet printing system. In this embodiment, the printing system 30 includes one or more ink reservoirs or cartridges 38, each of which is associated with a fluid ejector or printhead (e.g., a thermal printhead or a piezoelectric printhead). Each reservoir/cartridge 38 houses an embodiment of the printing composition described herein. Loading of the composition may be accomplished, e.g., by filling the reservoir 38 with the composition, which is operatively connected to the fluid ejector or printhead. The cartridge 38 is then loaded into the printing system 30.

The system 30 also includes the corona generator 32'. As illustrated in FIG. 2, the generator 32' is located downstream from the ink cartridge(s) 38 so that the corona discharge that is generated by the generator 32' is exposed to the printed composition.

Both the fluid ejector/printhead and the corona generator 32' are operatively connected to a controller 39, which is capable of running suitable software routines or programs for receiving desirable digital images, and generating commands for the fluid ejector/printhead and the corona generator 32' to reproduce the digital images on a substrate 10.

When it is desirable to print, a substrate 10 is introduced into the system 30 via a feeding mechanism 41 (e.g., including a feed tray, rollers or the like, and an exit tray), which is configured to move the substrate 10 through the printing system 30. Depending upon the digital image to be printed, the controller 39 transmits suitable firing commands to one or more of the printheads to deposit the printing composition(s) 18 in the form of fluid drops onto one or more portions of the substrate 10 to form the desired image. In instances where at least one of the printing compositions used is a fixer or gloss enhancer, the colorless composition may be deposited onto the substrate 10 after the colored ink composition(s) has/have been deposited or at the same time that the colored ink composition(s) is/are being deposited.

Once the printing composition(s) 18 has/have been deposited onto the substrate 10 surface, the feeding mechanism 41 moves the coated substrate in the vicinity of the corona generator 32'. The controller 39 transmits suitable commands to the generator 32' to generate a discharge, thereby forming the reactive species in-situ in the presence of the printed composition(s) 18. It is to be understood that the cartridge 38 and the generator 32' may be positioned at any desirable distance from each other, so that ink depositing and corona discharge occur substantially simultaneously (e.g., when the cartridge 38 and generator 32' are at most a few millimeters apart) or sequentially (e.g., when the distance between the cartridge 38 and generator 32' is far enough that there is definitive break between ink deposition and corona discharge). The distance between the cartridge 38 and the generator 32' may range anywhere from 1 mm to 100 cm. Furthermore, multiple pairs of ink cartridges 38 and corona dischargers 32' may be lined up along the feeding mechanism such that different printing compositions may be jetted and exposed to corona discharge in a sequential manner. Alternatively, a carriage may house multiple ink cartridges 38 so that multiple compositions are printed simultaneously and then exposed to corona discharge.

The high energy species generated during corona discharge initiates crosslinking and, in some instances, polymerization (e.g., where extensive crosslinking occurs) of the hydrocarbon(s) of the printed composition/ink layer 18 to form a polymer matrix 12 on the surface of the substrate 10 (i.e., to form print 20). More specifically, the polymerizing and/or crosslinking of the hydrocarbon polymer precursor in the composition 18 forms a substantially continuous hydrocarbon polymer matrix. In an example, when pigments are included in the composition and the polymer coverage extends over a length or diameter of at least 100 μm, the hydrocarbon polymer matrix 12 is considered to be a thin film, whereas when no colorants (i.e., no pigments or dyes) are included and the polymer coverage extends over a length or diameter of at least 100 μm, the polymer matrix 12 is considered to be a thin layer. It is to be understood, however, that compositions including i) a mixture of a dye and a pigment, and/or ii) a dye and a polymer(s) may, in some cases, result in a thin film. As previously mentioned, the polymer matrix 12 may also be printed in any suitable pattern, including dots, lines, etc.

Figure 3A:
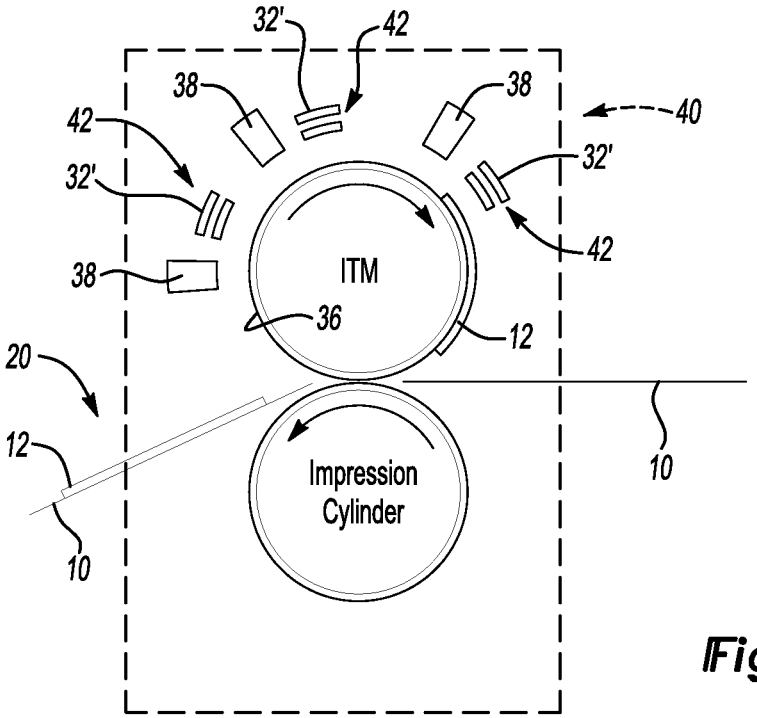
FIGS. 3A and 3B are schematic illustrations of other embodiments of a digital printing system for performing the method depicted in FIG. 1 where the printing composition is first printed onto an intermediate transfer medium.
Figure 3B:
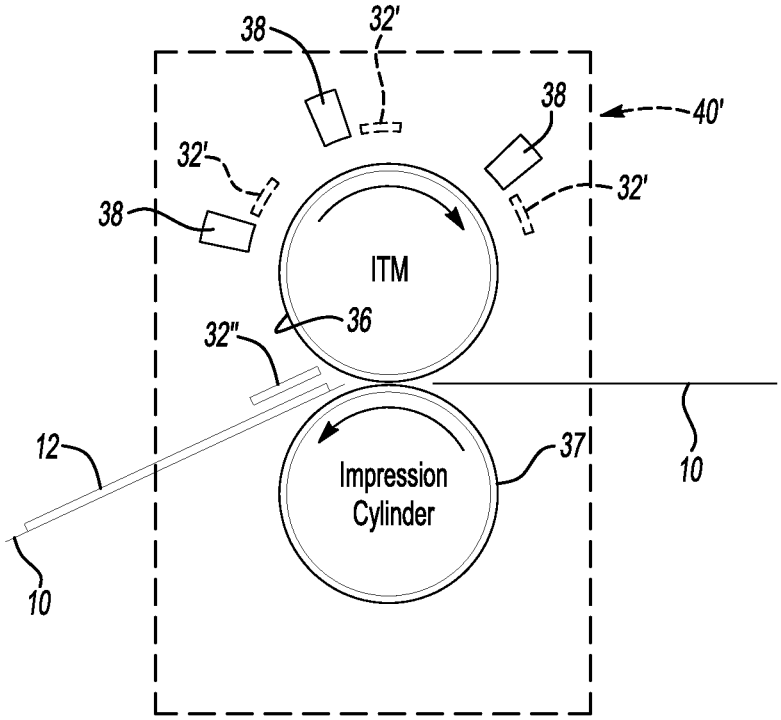

FIGS. 3A and 3B illustrate other embodiments of the system 40, 40' are respectively depicted. These systems 40, 40' are two examples of other digital inkjet printing systems. In these embodiments, the printing systems 40, 40' include one or more ink reservoirs or cartridges 38, each of which is associated with a fluid ejector or printhead (e.g., a thermal printhead or a piezoelectric printhead). As set forth in regard to FIG. 2, each reservoir/cartridge 38 houses an embodiment of the printing composition described herein. These embodiments of the system 40, 40' also include the corona generators 32' and/or 32" (or, for example, the array 42 of generators 32' shown in FIG. 3A) positioned at some point downstream of where the compositions are initially printed. In the examples shown in FIGS. 3A and 3B, each cartridge 38 is associated with a respective corona generator 32', such that each deposited ink from a respective cartridge 38 is subjected to corona discharge after it is deposited. Alternately, the ink cartridges 38 may be lined up sequentially with a single corona generator 32" positioned downstream to expose all of the deposited compositions to the discharge at one time (e.g., if the generators 32' shown in phantom in FIG. 3B were removed).

These embodiments of the system 40, 40' include an intermediate transfer medium ITM and an impression controller IC. The ITM may be, for example, a dielectric drum, that is configured to rotate in a first direction (denoted by the right pointing arrow), while the IC is configured to rotate in a second direction (denoted by the left pointing arrow) that is opposite to the rotation direction of the ITM. These two components ITM and IC operate such that the polymer matrix 12 can be transferred from the ITM to the substrate 10, which is guided by the IC (see FIG. 3A), or such that the printed composition 18 (i.e., ink layer) can be transferred from the ITM to the substrate 10, which is guided by the IC (see, e.g., FIG. 3B when the additional generators 32' shown in phantom are not included).

While not shown, it is to be understood that each of the components are in operative communication with a controller that is capable of running suitable software routines or programs for receiving desirable digital images, and generating commands for the fluid ejector/printhead, the corona generator(s) 32', the ITM and the IC to reproduce the digital images on a substrate 10.

Referring now specifically to FIG. 3A, the cartridge(s) 38 are operatively positioned such that the printing composition(s) is/are printed directly onto a surface 36 of the ITM such that a composition/ink layer 18 (not shown) is formed on the surface 36. Depending upon the digital image to be printed, the controller (not shown) transmits suitable firing commands to one or more of the printheads to deposit the printing composition(s) in the form of fluid drops onto one or more portions of the ITM to form the desirable image thereon. In instances where at least one of the printing compositions used is a fixer or gloss enhancer, the colorless composition may be deposited onto the ITM after the colored ink composition(s) has/have been deposited or at the same time that the colored ink composition(s) is/are being deposited.

In this embodiment, multiple corona generator arrays 42 are positioned adjacent to the surface 36 of the ITM, so that when the ITM is rotated, the composition/ink layer 18 printed from one cartridge 38 is moved in the vicinity of the adjacent array 42 positioned directly downstream of the cartridge 38. The controller transmits suitable commands to each of the generators 32' in the array 42 to generate a discharge, thereby forming the reactive species in-situ in the presence of the printed composition(s) 18. The high energy species initiates crosslinking and, in some instances, polymerization (e.g., where extensive crosslinking occurs) of the hydrocarbon(s) of the printed composition/ink layer 18 to form the polymer matrix 12 on the surface of the ITM. In this embodiment, corona discharge is generated after each ink is deposited.

Upon further rotation of the ITM and upon introduction of the substrate 10 onto the impression controller IC, the polymer matrix 12 is transferred from the ITM to the surface of the substrate 10. As illustrated in FIG. 3A, the print 20 then exits the printing system 40.

Referring now specifically to FIG. 3B, the cartridge(s) 38 are again operatively positioned such that the printing composition(s) is/are printed directly onto a surface 36 of the ITM such that a composition/ink layer 18 is formed on the surface 36. Depending upon the digital image to be printed, the controller (not shown) transmits suitable firing commands to one or more of the printheads to deposit the printing composition(s) in the form of fluid drops onto one or more portions of the ITM to form the desirable image thereon. In instances where at least one of the printing compositions used is a fixer or gloss enhancer, the colorless composition may be deposited onto the ITM after the colored ink composition(s) has/have been deposited or at the same time that the colored ink composition(s) is/are being deposited.

Respective corona generators 32' (shown in phantom) may also be included to initiate crosslinking/polymerization after each respective composition is deposited. When the generators 32' are included, the polymer matrix 12 is formed on the ITM and is transferred to the substrate 10 upon rotation of the ITM (similar to FIG. 3A). In this embodiment, the additional generator 32" (shown downstream of the transfer to the substrate 10) is used to enhance crosslinking/polymerization and/or to enhance adhesion between the polymer matrix 12 and the substrate 10.

Alternately, the corona generators 32' shown in phantom may be excluded, and the composition 18 would be formed on the ITM (i.e., corona discharge would not take place on the ITM). In this embodiment, upon rotation of the ITM and upon introduction of the substrate 10 onto the impression controller IC, the composition/ink layer 18 is transferred from the ITM to the surface of the substrate 10. In this embodiment, the corona generator 32" (or if desirable, array 42) is positioned adjacent to the surface 37 of the IC, so that when the IC is rotated, the composition/ink layer 18 on the substrate 10 is moved in the vicinity of the generator 32". The controller transmits suitable commands to the generator 32" to generate a discharge, thereby forming the reactive species in-situ in the presence of the printed composition(s) 18. The high energy species initiates crosslinking and, in some instances, polymerization (e.g., where extensive crosslinking occurs) of the hydrocarbon(s) of the printed composition/ink layer 18; thereby forming the polymer matrix 12 on the surface of the substrate 10 just prior to the substrate 10 exiting the printing system 40'.

Figure 4:
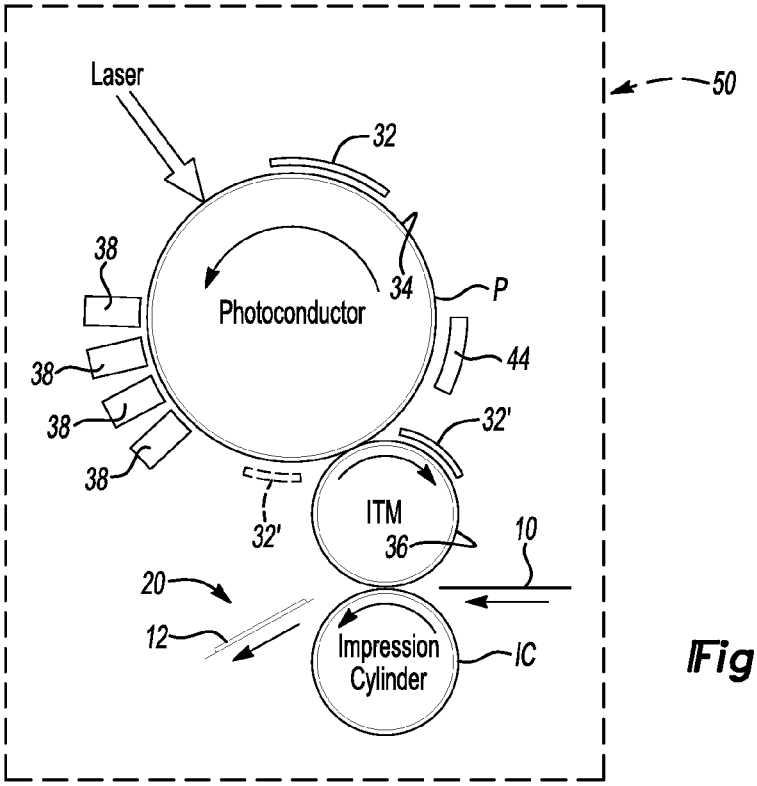
FIG. 4 is a schematic illustration of still another embodiment of a digital printing system for performing the method depicted in FIG. 1 where the printing composition is first printed onto a photoconductor.

Still another embodiment of the system 50 is shown in FIG. 4. This system 50 is one embodiment of an electrophotographic system. The printing system 50 includes a photoconductor P that is configured to rotate in a first direction (as denoted by the left pointing arrow in the photoconductor P). The photoconductor P has a surface 34 that may be exposed to various elements of the system 50 when the photoconductor P is rotated.

A first corona generator 32 (such as, e.g., the previously mentioned printer wire or array of printer wires configured to generate corona discharge) is operatively positioned adjacent to a portion of the surface 34 of the photoconductor P. When the system 50 is in operation, the corona discharge from corona generator 32 generates a charge on the portion of the photoconductor surface 34 exposed to the discharge. It is to be understood that the photoconductor P rotates to develop a uniform layer of charge on the surface 34. As previously described, the charge may be positive or negative, depending upon the type of corona generator 32 used.

The system 50 also includes a laser (labeled "LASER" in FIG. 4) that is positioned adjacent to the photoconductor surface 34. Generally, the laser is positioned such that as the photoconductor P rotates in the first direction, some of the areas of the surface 34 exposed to the corona discharge from the generator 32 are exposed to the emission from the laser. The laser is selected so that its emission can generate charges opposite to those already present on the surface 34 from within the photoconductor 34. By virtue of creating these opposite charges, the laser effectively neutralizes the previously formed charges at areas exposed to the laser emission. This neutralization forms a latent image. It is to be understood that those areas of the surface 34 not exposed to the laser remain charged.

A controller or processor (not shown) operatively connected to the laser commands the laser to form the latent image so that the remaining charged portions of the surface 34 can be used to generate the desirable digital image. The processor is capable of running suitable software routines or programs for receiving desirable digital images, and generating commands to reproduce the digital images using the laser, as well as other components of the system 50.

The system 50 further includes at least one ink reservoir/cartridge 38 containing an embodiment of the composition disclosed herein (i.e., includes the hydrocarbon carrier). It is to be understood that, in one embodiment, the inks are selected to carry a charge that is opposite to that of the uniform layer of charge on the surface 34. The ink reservoir(s)/cartridge(s) 38 are also operatively positioned to deposit the ink(s) onto the remaining charged portion(s) of the surface 34 to form an ink layer (e.g., 18, not shown in this Figure) on the surface 34 of the photoconductor P. It is to be understood that the charges remaining on the surface 34 after exposure to the laser will attract the oppositely charged ink(s).

Additionally or alternatively, it is to be understood that electrically neutral carrier(s) (i.e., inks without colorants) can be deposited on the discharged (i.e., neutralized) regions or the remaining charged regions of the surface 34, so that cross-linking/polymerization results in the formation of a continuous image (e.g., a polymer matrix 12 including colored and colorless areas) that is transferred to the substrate 10. Likewise, charged ink can be transferred from cartridge(s) 38 onto the discharged (i.e., neutralized) regions on the surface 34 by applying an appropriate potential bias between the cartridges 38 and the surface 34.

As illustrated in FIG. 4, the system 50 further includes the (in this instance second) corona generator 32' positioned adjacent to either the photoconductor P or an intermediate transfer medium ITM (which rotates in a second direction (as denoted by the right pointing arrow) that is opposite to direction of rotation of the photoconductor P). It is to be understood that the ITM is grounded or positively biased with respect to the photoconductor P.

When positioned adjacent to the photoconductor P, it is to be understood that the generator 32' produces the reactive/charged species that is exposed to the ink layer (e.g., layer 18, not shown) while such layer is still positioned on the surface 34 of the photoconductor P. In this embodiment, the generator 32' is positioned between the ink reservoirs/cartridges 38 and the ITM. The corona discharge from this embodiment of the generator 32' initiates at least one of polymerization or crosslinking of the hydrocarbon in the ink layer to form the polymer matrix 12 on the surface of the photoconductor P. As the photoconductor P continues to rotate, the polymer matrix 12 is then transferred to the intermediate transfer medium ITM. As illustrated in FIG. 4, the system 50 further includes an impression cylinder IC that is rotatable in the first direction (i.e., the same direction as the photoconductor P). The impression cylinder IC guides the substrate 10 such that a surface of the substrate 10 contacts the polymer matrix 12 on the rotating intermediate transfer medium ITM. When in contact, the polymer matrix 12 transfers to the substrate 10.

When positioned adjacent to the intermediate transfer medium ITM, it is to be understood that the generator 32' produces a charged species that is exposed to the ink layer after the layer has been transferred from the surface of the photoconductor 34 to the surface 36 of the ITM. In this embodiment, the generator 32' is positioned adjacent to the surface 36 of the ITM at an area beyond where the ink layer transfer takes place. The corona discharge from this embodiment of the generator 32' initiates at least one of crosslinking or polymerization of the hydrocarbon in the ink layer to form the polymer matrix 12 on the surface 36 of the ITM. As the intermediate transfer medium ITM continues to rotate, the polymer matrix 12 is transferred to the substrate 10 guided by the impression cylinder IC that is rotatable in the first direction (i.e., opposite to the rotation of the ITM). The impression cylinder IC guides the substrate 10 such that a surface of the substrate 10 contacts the polymer matrix 12 on the rotating intermediate transfer medium ITM. When in contact, the polymer matrix 12 transfers to the substrate 10.

The system 50 also includes a charge neutralization unit 44 positioned after the ITM and adjacent to the surface 34 of the photoconductor P. The charge neutralization unit 44 neutralizes any opposite charges remaining on the surface 34 of the photoconductor P prior to the next cycle of printing.

Figure 5:
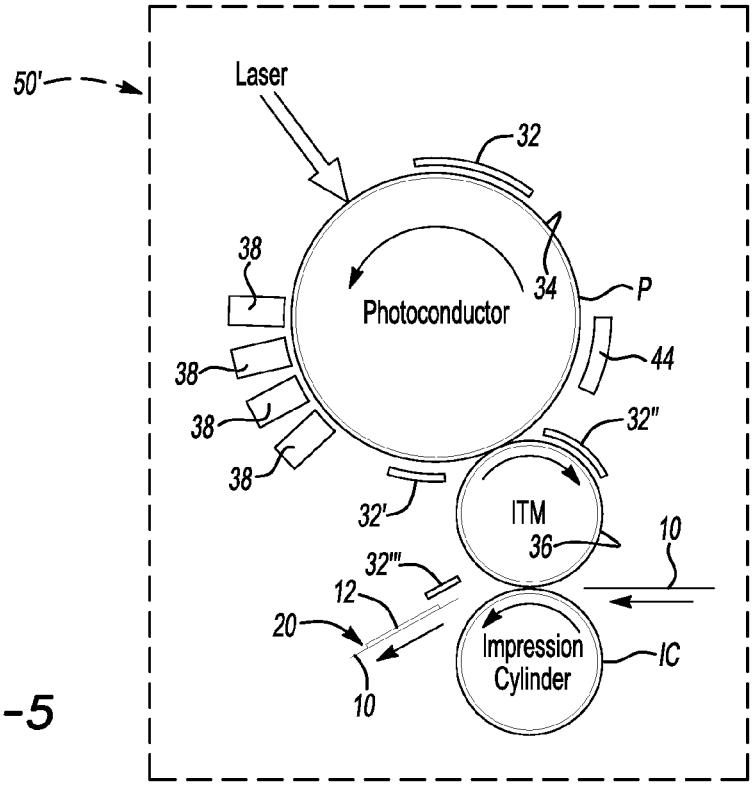
FIG. 5 is a schematic illustration of yet another embodiment of a digital printing system for performing the method depicted in FIG. 1 where the printing composition is first printed onto a photoconductor.

Referring now to FIG. 5, another embodiment of the electrophotographic system 50' is depicted. This system 50' is similar to the system 50 shown in FIG. 4, except that additional corona generators 32, 32', 32", 32'" are included. In this embodiment, the first generator 32 creates the uniform charge surface on the photoconductor P, and the second generator 32' initiates crosslinking and/or polymerization of the ink layer (e.g., layer 18, not shown) while it is on the surface 34 of the photoconductor P.

It is believed that the third corona generator 32" may be used to improve the efficiency of the crosslinking and/or polymerization. In this embodiment, the third generator 32" is positioned adjacent to the intermediate transfer medium ITM. In some instances, after exposure to the corona discharge from the second generator 32', crosslinking and/or polymerization of the hydrocarbons in the polymer matrix 12 may not be complete upon transfer of the polymer matrix 12 to the ITM. The third generator 32" produces yet another charged species that is exposed to the polymer matrix 12 after the layer has been transferred from the surface of the photoconductor 34 to the surface of the ITM. In one non-limiting example, about 80% of the hydrocarbons are crosslinked and/or polymerized after exposure to the charged species from generator 32', and exposure to the charged species from the generator 32" may increase the percentage of crosslinked and/or polymerized hydrocarbons in the polymer matrix 12. In this embodiment, the third generator 32" is positioned adjacent to the surface 36 of the ITM at an area beyond where the polymer matrix 12 transfer takes place. As previously mentioned, the corona discharge from the third generator 32" is believed to enhance the polymerization or crosslinking, by exposing any remaining unreacted hydrocarbons in the polymer matrix 12 to complete formation of the polymer matrix 12 on the surface 36 of the ITM.

As the intermediate transfer medium ITM continues to rotate, the polymer matrix 12 is transferred to the substrate 10 guided by the impression cylinder IC that is rotatable in the first direction (i.e., opposite to the rotation of the ITM). The impression cylinder IC guides the substrate 10 such that a surface of the substrate 10 contacts the polymer matrix 12 on the rotating intermediate transfer medium ITM. When in contact, the polymer matrix 12 transfers to the substrate 10. As illustrated in FIG. 5, the system 50' may also include a fourth corona generator 32'". This generator 32'" may be positioned adjacent to the impression cylinder IC at any area beyond where the polymer matrix 12 has been transferred to the substrate 10. This generator 32'" produces yet another charged/reactive species that aids in fixing the polymer matrix 12 to the substrate 10.

The system 50' also includes a charge neutralization unit 44 positioned after the ITM and adjacent to the surface 34 of the photoconductor P. The charge neutralization unit 44 neutralizes any opposite charges remaining on the surface 34 of the photoconductor P prior to the next cycle of printing.

In some of the embodiments disclosed herein, the transfer of the polymer matrix 12 to the substrate 10 may be aided via pressure transfer or by tailoring the glass transition temperature (Tg) of the polymer matrix 12 to be from about 50° C. to about 120° C. Tailoring the Tg may be accomplished by selecting the hydrocarbon polymer precursors so that the resulting polymer matrix 12 incorporates both low temperature and high temperature melting or softening polymers. In an example, low melting temperature polymers include those that melt or soften (e.g., have a Vicat softening point) at temperatures ranging from about room temperature (e.g., 20° C.) to 80° C., and high melting temperature polymers include those that melt or soften at temperature that are greater than 80° C. Alternatively, tailoring the Tg may be accomplished by adding oligomers to the hydrocarbon polymer precursors. Examples of suitable oligomers include those having more than three, but less than ten repeating units. For instance, the oligomer may be a short chain version of an acrylic acid, such as an acrylic acid having five repeating units (rendering the acrylic acid as a polymer). When the Tg is tailored, internal or external heating at the ITM may be used to create a tacky polymer matrix 12 to aid in the transfer of the polymer matrix 12 to the substrate 10.

Figure 6:
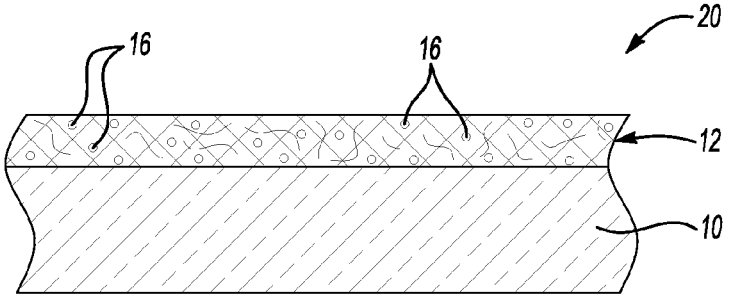
FIG. 6 is a schematic illustration (not drawn to scale) of an embodiment of a print including a crosslinked or polymerized matrix of a printing composition established on a substrate.

FIG. 6 illustrates the print 20 formed via any of the systems 30, 40, 40', 50, 50' disclosed herein. The print 20 includes the substrate 10 and the polymer matrix 12 adhered thereto. The formed polymer matrix 12 sufficiently adheres to the substrate 10 surface such that additional adhesive materials are not required. The polymer matrix 12 is substantially immediately fixed to the substrate 10 upon polymerization and/or crosslinking (see, e.g., FIGS. 2 and 3B) or upon transfer from the ITM (see, e.g., FIGS. 3A, 4, and 5), and thus desirable page attributes (e.g., scratch and rub resistance) may be achieved when printing on both porous and non-porous substrates 10.

It is to be understood that in any of the embodiments disclosed herein, the substrate 10 may be selected from any porous or non-porous substrate. Some non-limiting examples of non-porous substrates include elastomeric materials (e.g., polydimethylsiloxane (PDMS)), semi-conductive materials (e.g., indium tin oxide (ITO) coated glass), dielectric materials, flexible materials (e.g., polycarbonate films, polyethylene films, polyimide films, polyester films, and polyacrylate films). Non-limiting examples of porous substrates include coated or uncoated paper.

In FIG. 6, a colorant (such as pigment particles 16) present in the original composition becomes embedded and/or entrapped in the resulting polymer matrix 12 of the polymerized and/or crosslinked hydrocarbon. The immobilized colorants 16 will thus be retained on the substrate 10 surface (i.e., do not penetrate into the substrate 10), which advantageously improves the print quality of the digital image on the print 20.

Furthermore, in an example, the thin hydrocarbon matrix 12 formed via the method(s) disclosed herein has a thickness ranging from about 10 nm to about 10 μm. In another example, the thickness ranges from 100 nm to tens of microns.

Still further, in the embodiments disclosed herein, the polymerizing and/or crosslinking of the hydrocarbon(s) may be controlled by the ambient environment within which the polymerizing and/or crosslinking is accomplished. For example, controlling polymerization and/or crosslinking may be accomplished by exposing the printed composition (e.g., ink layer 18) to radiation at a wavelength ranging from about 100 nm to about 1500 nm (such as, e.g., ultraviolet radiation, infrared radiation, etc.) and/or exposing the composition to an elevated temperature (e.g., from about 80° C. to about 120° C.). The UV radiation generally accompanies the corona discharge and produces additional reactive radicals that can initiate crosslinking/polymerization. The elevated temperature may be used to accelerate the rate of crosslinking/polymerization and/or to reduce any activation barrier(s).

In other instances, polymeriziation and/or crosslinking may be further controlled by incorporating a catalyst (such as, e.g., triethylaluminium (TEA), methylaluminoxane (MAO), etc.) in the printing composition, and then activating the catalyst upon polymerization. The catalyst may be incorporated in order to facilitate crosslinking/polymerization from within the printed ink composition 18, for example, in areas that may not easily be reached by the reactive species.

To further illustrate embodiment(s)/example(s) of the present disclosure, the following examples are given herein. It is to be understood that these examples are provided for illustrative purposes and are not to be construed as limiting the scope of the disclosed embodiment(s)/example(s).

EXAMPLES

Example 1

Figure 7A:
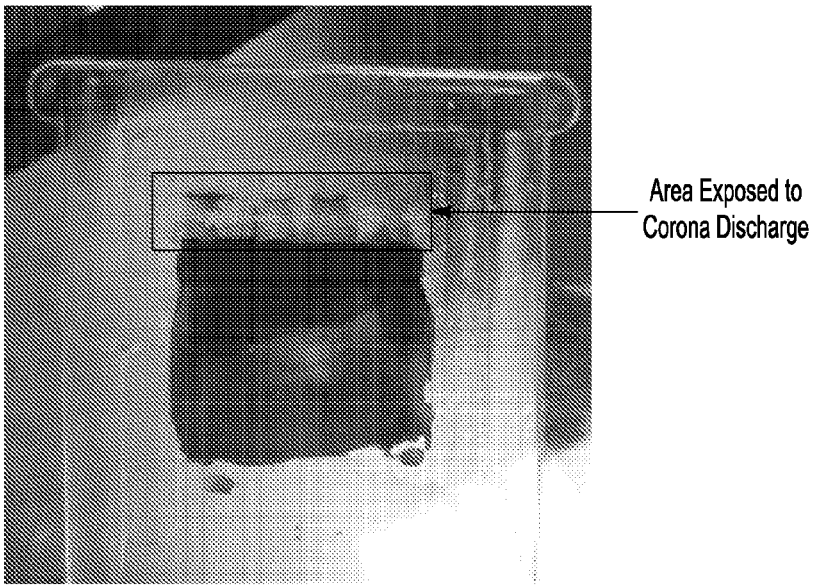
FIGS. 7A through 7D are photographs depicting the formation of a hydrocarbon matrix when exposed to corona discharge at a current of 300 μA (shown in FIG. 7A), the hydrocarbon matrix of FIG. 7A after rinsing (shown in FIG. 7B), results of a highlighter smear fastness experiment for a sample using the hydrocarbon matrix of FIG. 7B (shown in FIG. 7C), and results of a highlighter smear fastness experiment for a comparative ink sample (shown in FIG. 7D)
Figure 7B:
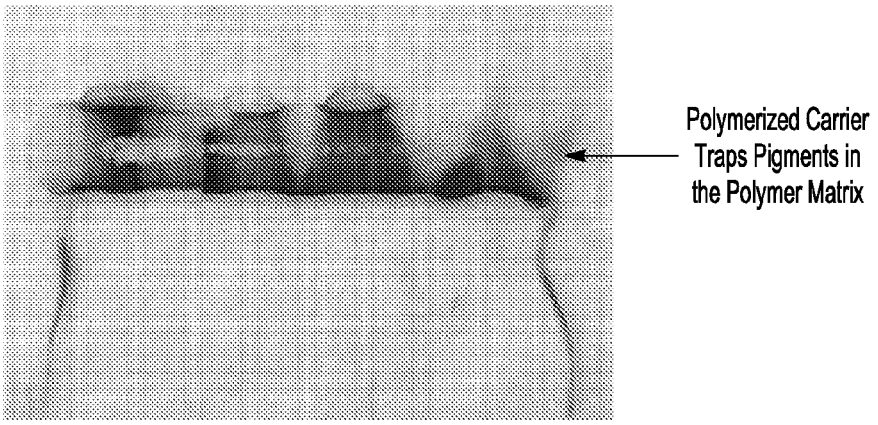

A sample of ink was prepared by dispersing 5 wt % of a cyan pigment in Linseed oil (available from Cargill, Inc., Minnetonka, Minn.) with 0.5 wt % of SOLSPERSE® 13940 dispersant in a M-110Y microfluidizer for about 40 minutes. The ink was smeared onto an indium tin oxide (ITO)-glass substrate, and then placed on an adjustable stage underneath a 1.5 inch wire corona. In this set up, the stage was adjusted so that the coated substrate was about 2 mm below the wire corona. The ink sample was exposed to corona discharge of 3.5 kV at a current of about 300 μA in air for about 1 minute (as shown in FIG. 7A), and then the ink sample was rinsed with ISOPAR™ L and isopropyl alcohol (IPA) to remove any unexposed ink (as shown in FIG. 7B).

A comparative sample was also prepared, where such comparative sample included a cyan pigment suspended in a non-polymerizable carrier. The formulation for the comparative sample was 5 wt % of cyan pigment dispersed in ISOPAR™ L with 1 wt % of SOLSPERSE® 13940 dispersant in a M-100Y microfluidizer for about 30 minutes. The comparative ink sample was also smeared onto an ITO-glass substrate, and was exposed to corona discharge of 3.5 kV at a current of about 90 μA in air for about 1 minute.

Figure 7C:
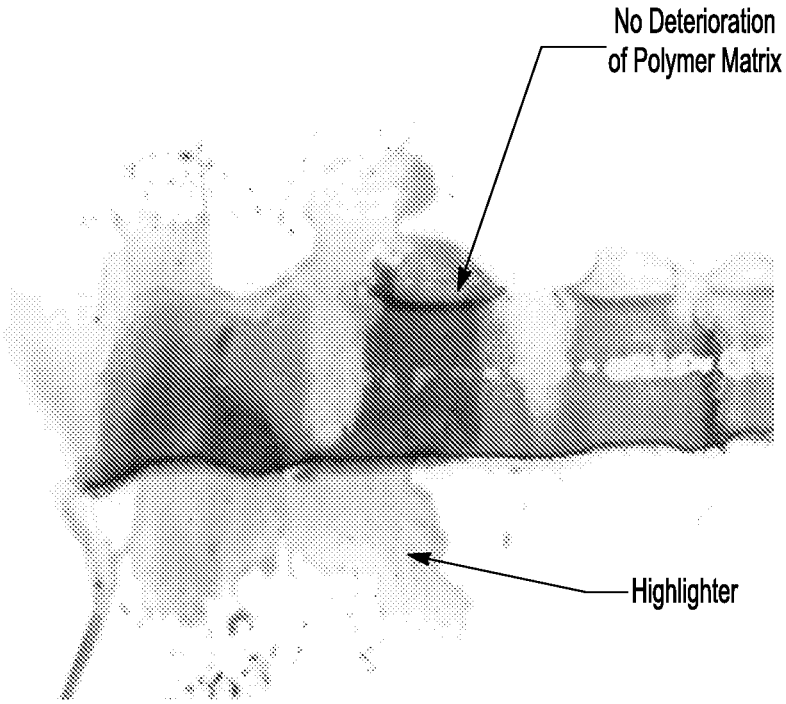
Figure 7D:
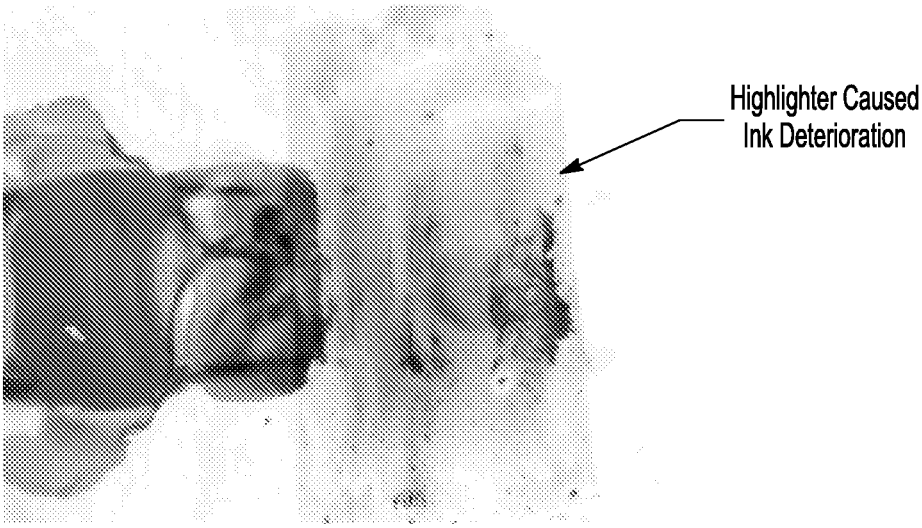

Highlighter smear fastness experiments were performed on both of the ink sample and the comparative sample, where the results of these experiments are shown in FIG. 7C for the ink sample, while the results are shown in FIG. 7D for the comparative sample. A highlighted was used to stroke each of the samples in a linear motion back and forth at a controlled stroke speed (2 cm/sec) and length (2 cm), and the head of the highlighter followed the contours of the samples.

As shown in FIG. 7C, after 10 passes of the highlighter smear experiment, no deterioration of the hydrocarbon matrix established on the substrate is evident. This is evidence of polymer formation of the ink on the substrate surface in the sample. However, as shown in the comparative sample in FIG. 7D, inks formulated without a polymerizable carrier suffer from highlighter smearing.

Example 2

Figure 8A:
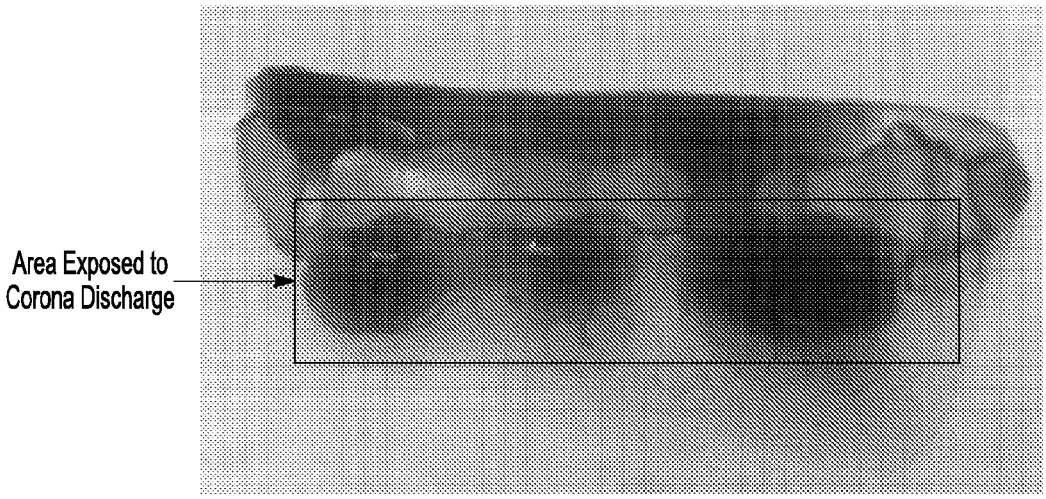
FIGS. 8A and 8B are photographs depicting the formation of a hydrocarbon matrix when exposed to corona discharge at a current of 90 μA (shown in FIG. 8A) and the hydrocarbon matrix of FIG. 8A after rinsing (shown in FIG. 8B).
Figure 8B:
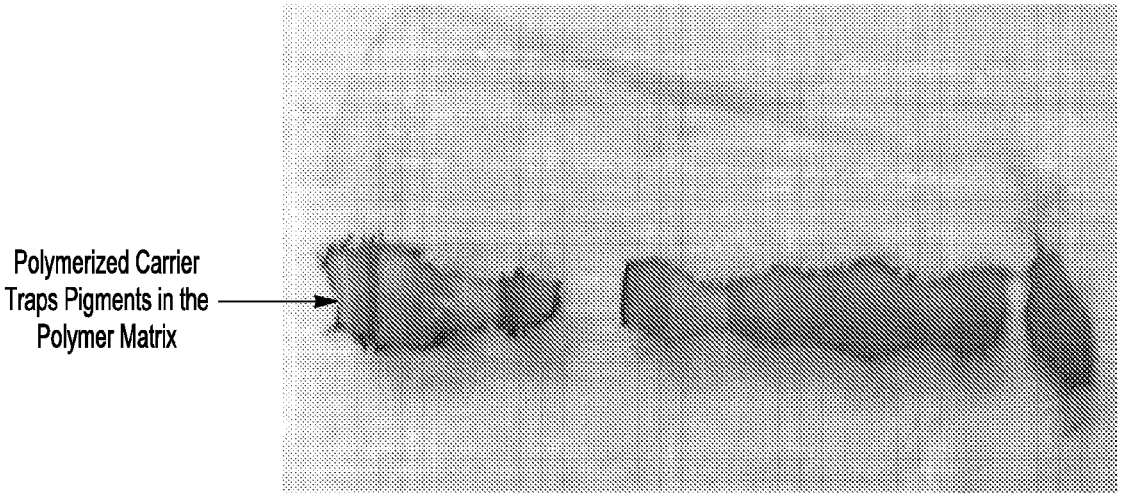

The same ink sample as described for Example 1 was prepared in Example 2. In this example, however, the ink sample was exposed to corona discharge of 3.5 kV under 90 μA of current in air for about 1 minute (as shown in FIG. 8A). After the ink sample was rinsed with ISOPAR® L and IPA to remove any unexposed ink. After rinsing, a polymer layer with pigments embedded therein is visible (as shown in FIG. 8B).

It is to be understood that the ranges provided herein include the stated range and any value or sub-range within the stated range. For example, an amount ranging from approximately 1 wt % to about 20 wt % should be interpreted to include not only the explicitly recited amount limits of 1 wt % to about 20 wt %, but also to include individual amounts, such as 2 wt %, 3 wt %, 4 wt %, etc., and sub-ranges, such as 5 wt % to 15 wt %, 10 wt % to 20 wt %, etc.

While several embodiments have been described in detail, it will be apparent to those skilled in the art that the disclosed embodiments may be modified. Therefore, the foregoing description is to be considered exemplary rather than limiting.

What is claimed is:

1. A printing system, comprising:

a first ejector in fluid communication with a reservoir, the reservoir containing a printing composition including a hydrocarbon having an unsaturated bond, the first ejector structured to eject the printing composition onto a surface, the hydrocarbon to at least one of polymerize or crosslink in a presence of a reactive species to form a polymer matrix from the ejected printing composition;

a second ejector structured to eject the printing composition onto the surface, the first ejector being radially spaced about the surface relative to the second ejector; and a corona generator to generate the reactive species in situ, the corona generator being positioned with respect to the reservoir such that the reactive species is exposed to the printing composition after the printing composition has been ejected onto the surface, wherein the surface is a surface of a photoconductor and the corona generator includes a first corona generator and a second corona generator, the first corona generator to generate the reactive species, the second corona generator to charge the photoconductor.

2. The printing system as defined in claim 1, further including a controller to transmit commands to printing system components to generate a printed image.

3. The printing system as defined in claim 1, wherein the printing composition further includes a colorant including a pigment, a dye or a combination thereof.

4. The printing system as defined in claim h in the hydrocarbon includes:

i) a first hydrocarbon having a conjugated unsaturated bond including a diene, an enone, or a terminal olefin;

ii) an oil including an unsaturated fatty acid, a glyceride, or a combination thereof; or iii) a halogenated hydrocarbon, a second hydrocarbon including a ketone, or a combination thereof.

5. The printing system as defined in claim 1, wherein the reactive species includes radicals, radical ions, carbenes, cations, anions, acids, bases, peroxides, or a combination thereof.

6. The printing system as defined in claim 1, wherein the corona generator includes an array of wires, each wire being spaced from each adjacent wire at a distance ranging from about 100 μm to about 2 mm.

7. The printing system as defined in claim 1, wherein the corona generator is positioned parallel to the surface upon which the printing composition is to be ejected, and the corona generator is positioned 10 mm or less from the surface upon which the printing composition is to be ejected.

8. The printing system as defined in claim 1, wherein the corona generator includes a first corona generator and a second corona generator, the second corona generator being downstream from the first corona generator.

9. The printing system as defined in claim 8, wherein the first corona generator is associated with the first ejector and the second corona generator is associated with the second ejector.

10. The printing system as defined in claim 1, wherein the surface is a surface of an intermediate transfer medium.

11. The printing system as defined in claim 10, wherein the corona generator includes a first corona generator and a second corona generator, the first corona generator being radially spaced about the intermediate transfer medium relative to the second corona generator to enable the first and second corona generators to form the polymer matrix on the intermediate transfer medium.

12. The printing system as defined in claim 1, further including an impression cylinder, the impression cylinder to guide a substrate to receive at least one of the polymer matrix or the printing composition from an intermediate transfer medium.

13. The printing system as defined in claim 12, wherein the corona generator is positioned adjacent the impression cylinder to enable the corona generator to form the polymer matrix on the substrate.

14. The printing system as defined in claim 1, wherein the first corona generator is positioned adjacent the photoconductor to enable the first corona generator to form the polymer matrix on the photoconductor.

15. The printing system as defined in claim 1, further including a laser to neutralize a portion of the photoconductor.

16. The printing system as defined in claim 1, further including an intermediate transfer medium, the intermediate transfer medium to receive at least one of the polymer matrix or the printing composition from the photoconductor.

17. The printing system as defined in claim 16, wherein the first corona generator is positioned adjacent the intermediate transfer medium to enable the first corona generator to form the polymer matrix on the intermediate transfer medium.

18. The printing system as defined in claim 16, further including an impression cylinder, the impression cylinder to guide a substrate to receive at least one of the polymer matrix or the printing composition from the intermediate transfer medium.

19. The printing system as defined in claim 18, wherein the first corona generator is positioned adjacent the impression cylinder to enable the corona generator to form the polymer matrix on the substrate.

20. The printing system as defined in claim 1, wherein the corona generator includes an array of corona generators.

21. A printing system, comprising:

an ejector in fluid communication with a reservoir, the reservoir containing a printing composition including a hydrocarbon having an unsaturated bond, the ejector structured to eject the printing composition onto a surface, the hydrocarbon to at least one of polymerize or crosslink in a presence of a reactive species to form a polymer matrix from the ejected printing composition;

a first corona generator to generate the reactive species in situ, the first corona generator being positioned with respect to the reservoir such that the reactive species is exposed to the printing composition after the printing composition has been ejected onto the surface;

a photoconductor to rotate in first direction and including a photoconductor surface;

a second corona generator positioned adjacent to the photoconductor surface, the second corona generator to expose the photoconductor surface to corona discharge to form a layer of charge on the photoconductor surface;

a laser positioned adjacent to the photoconductor surface, the laser to generate light to neutralize a first portion of the layer of charge on the photoconductor surface to form a latent image, the printing composition in the reservoir carries a charge opposite to that of the layer of charge, a second portion of the layer remaining charged, the ejector to deposit the printing composition on the second portion of the layer to form an ink layer on the photoconductor surface, the first corona generator being positioned to produce the reactive species that initiates at least one of polymerization or crosslinking of the hydrocarbon in the ink layer on the photoconductor surface, the reactive species to initiate the at least one of polymerization or crosslinking of the hydrocarbon in the ink layer on the surface of the photoconductor to form the polymer matrix;

an intermediate transfer medium to receive the polymer matrix from the photoconductor; and a third corona generator positioned adjacent to the intermediate transfer medium in order to produce another reactive species that enhances the at least one of polymerization or crosslinking of remaining hydrocarbons in the polymer matrix after the polymer matrix has been transferred to the intermediate transfer medium.

22. A printing system, comprising:

an ejector in fluid communication with a reservoir, the reservoir containing a printing composition including a hydrocarbon having an unsaturated bond, the ejector structured to eject the printing composition onto a surface, the hydrocarbon to at least one of polymerize or crosslink in a presence of a reactive species to form a polymer matrix from the ejected printing composition, a first corona generator to generate the reactive species in situ, the first corona generator being positioned with respect to the reservoir such that the reactive species is exposed to the printing composition after the printing composition has been ejected onto the surface, wherein the first corona generator includes an array of wires, each wire being spaced from each adjacent a distance ranging from about 100 μm to about 2 mm;

a photoconductor to rotate in a first direction and including a photoconductor surface;

a second corona generator positioned, adjacent to the photoconductor surface, the second corona generator to expose the photoconductor surface to corona discharge to form a layer of charge thereon;

a laser positioned adjacent to the photoconductor surface, the laser to generate light to neutralize a portion of the layer of charge on the photoconductor surface to form a latent image, the printing composition in the reservoir carries a charge opposite to that of the layer of charge, the reservoir is to deposit the printing composition on a remaining charged portion of the layer of charge to form an ink layer on the surface of the photoconductor; and an intermediate transfer medium that is rotatable in a second direction opposite to the first direction, the intermediate transfer medium is to receive, on a surface thereof, the ink layer from the photoconductor surface, the first corona generator being positioned to produce the reactive species that initiates at least one of polymerization or crosslinking of the hydrocarbon in the ink layer on the intermediate transfer medium surface.

23. A printing system, comprising:

an ejector in fluid communication with a reservoir, the reservoir containing a printing composition including a hydrocarbon having an unsaturated bond, the ejector structured to eject the printing composition onto a surface, the hydrocarbon to at least one of polymerize or crosslink in a presence of a reactive species to form a polymer matrix from the ejected printing composition;

a first corona generator to generate the reactive species in situ, the first corona generator being positioned with respect to the reservoir such that the reactive species is exposed to the printing composition after the printing composition has been ejected onto the surface, the first corona generator is positioned parallel to the surface upon which the printing composition is to be ejected, and the first corona generator is positioned 10 mm or less from the surface upon which the printing composition is to be ejected;

a photoconductor to rotate in a first direction and including a photoconductor surface;

a second corona generator positioned adjacent to the photoconductor surface, the second corona generator to expose the photoconductor surface to corona discharge to form a layer of charge thereon; and a laser positioned adjacent to the photoconductor surface, the laser to generate light to neutralize a portion of the layer of charge on the photoconductor surface to form a latent image, the printing composition in the reservoir carries a charge opposite to that of the layer of charge, the reservoir is to deposit the printing composition on a remaining charged portion of the layer of charge to form an ink layer on the photoconductor surface; and an intermediate transfer medium that is rotatable in a second direction opposite to the first direction, the intermediate transfer medium is to receive, on a surface thereof, the ink layer from the photoconductor surface, the first corona generator being positioned to produce the reactive species to initiate at least one of polymerization or crosslinking of the hydrocarbon in the ink layer on the intermediate transfer medium surface.

* * * * *